US007260225B2

(12) United States Patent
Teichmann et al.

(10) Patent No.: US 7,260,225 B2
(45) Date of Patent: Aug. 21, 2007

(54) METHOD AND DEVICE FOR PROCESSING A STEREO AUDIO SIGNAL

(75) Inventors: Bodo Teichmann, Nuernberg (DE); Oliver Kunz, Sesslach (DE); Juergen Herre, Buckenhof (DE); Klaus Peichl, Erlangen (DE); Michael Beer, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 711 days.

(21) Appl. No.: 10/149,248

(22) PCT Filed: Dec. 7, 2000

(86) PCT No.: PCT/EP00/12352

§ 371 (c)(1),
(2), (4) Date: Aug. 15, 2002

(87) PCT Pub. No.: WO01/43503

PCT Pub. Date: Jun. 14, 2001

(65) Prior Publication Data

US 2003/0091194 A1 May 15, 2003

(30) Foreign Application Priority Data

Dec. 8, 1999 (DE) ..... 199 59 156

(51) Int. Cl.
*H04H 5/00* (2006.01)

(52) U.S. Cl. ..... 381/10

(58) Field of Classification Search ..... 381/2, 381/22, 23, 10

See application file for complete search history.

(56) References Cited

U.S. PATENT DOCUMENTS 4,032,717 A 6/1977 Mallon
5,181,249 A * 1/1993 Schiller ..... 381/27

(Continued)

FOREIGN PATENT DOCUMENTS

EP 0 574 145 A1 12/1993

(Continued)

*Primary Examiner*—Curtis A. Kuntz
*Assistant Examiner*—Alexander Jamal
(74) *Attorney, Agent, or Firm*—Michael A. Glenn; Glenn Patent Group

(57) ABSTRACT

In a device for processing a stereo audio signal having a first channel and a second channel the stereo signal is at first analyzed to obtain a measure for a quantity of bits required by a coder to code the stereo audio signal using a coding algorithm. The first channel and the second channel are then modified when the measure for the quantity of bits is larger than a predetermined value, the modification being performed in such a way that the energy of a sum signal of the first and the second modified channel is in a predetermined relation to the energy of a sum signal of the first and the second channel and that a difference signal of the first and the second modified channel is attenuated in contrast to the difference signal of the first and the second channel. Especially for audio coders requiring a constant output bit rate the side channel is attenuated in the case of stereo audio signals, the coding of which cannot meet the output bit rate of the coder, by which a stereo channel separation is abandoned for the benefit of an increased audio bandwidth or a reduction of quantizing disturbances, respectively.

18 Claims, 2 Drawing Sheets

U.S. PATENT DOCUMENTS 5,228,093 A 7/1993 Agnello
5,278,909 A 1/1994 Edgar
5,285,498 A 2/1994 Johnston
5,491,773 A 2/1996 Veldhuis et al.
5,825,830 A * 10/1998 Kopf ..... 375/340
5,859,826 A 1/1999 Ueno et al.
5,870,480 A * 2/1999 Griesinger ..... 381/18
6,345,246 B1 2/2002 Moriya et al.
6,356,211 B1 3/2002 Shimoyoshi et al.
6,784,812 B2 * 8/2004 Craven et al. ..... 341/50

FOREIGN PATENT DOCUMENTS

JP 08-289900 6/1996
WO WO99/43110 8/1999

* cited by examiner

METHOD AND DEVICE FOR PROCESSING A STEREO AUDIO SIGNAL

FIELD OF THE INVENTION

The present invention generally relates to coding audio signals and especially to processing stereo signals.

BACKGROUND OF THE INVENTION AND PRIOR ART

A stereo signal includes at least two channels, that is a left channel and a right channel. In addition, stereo signals may also comprise a left and a right surround channel. There is also the possibility that a stereo signal comprises five different channels, that is a front left channel, a front center channel and a front right channel as well as a left back channel and a right back channel.

For a data-reduced coding of stereo signals, there is the possibility that similarities of at least two channels can be made use of to reduce the quantity of bits required to code a stereo signal with at least two channels.

A well-known method for processing stereo signals to obtain an efficient coding is called center/side method (M/S method). In the M/S method, the first channel and the second channel are combined with each other to give a center channel and a side channel. For reasons of clarity, it is not a first and a second channel which are mentioned herein, but a left channel (L channel) and a right channel (R channel). It is known that the center channel equals the sum of the left channel L and the right channel R, multiplied by a factor of 0,5, while the side channel is the difference of the left channel L and the right channel R, multiplied by a factor of, for example, 0,5 (other factors are also possible). Expressed as an equation, this means:

$$M=0,5\cdot(L+R)$$

$$S=0,5\cdot(L-R)$$

If the left channel L and the right channel R are relatively similar to each other, an M/S processing brings a considerable saving of the bit quantity required for coding, since the side channel will have relatively less energy than R or L. In the borderline case in which the left channel L and the right channel R are identical, the center channel will equal the left channel L or the right channel R, while the side channel equals 0. It can be seen that, due to the fact that the side channel equals 0, a theoretical maximum bit rate saving when coding of 50% is obtained, since only the center channel has to be coded, while not a single bit has to be devoted to the side channel.

Thus, there is the general rule that the more similar the right and left channels are, the smaller, that is, lower in energy, the side channel will be and the less bits will be required for coding the side channel.

A listener will perceive the similarity of the left and the right channel in that, in the case of identical channels, a speaker or an orchestra are perceived in the very middle between the two loudspeakers. On the other hand, a listener will perceive dissimilar channels in that he has a pronounced stereo effect, that is a speaker, an orchestra or individual instruments of an orchestra can be localized precisely on the left and/or the right. If the case is considered that the left channel comprises a high amount of energy and that the right channel only comprises little energy, that is the case in which, for example, a single instrument is arranged on the very left side in the recording room and is only audible in the left channel while there is solely some noise on the right channel, the center channel, after an M/S processing, will approximately equal the left channel. In addition, the side channel will approximately equal the left channel. In this case, both the center channel and the side channel contain approximately the same amount of energy and both have to be coded by a relatively large number of bits. Compared to the original case, the bit quantity required for coding in this signal constellation has not decreased due to the M/S coding but, in the borderline case, even doubled when it is assumed that the left channel L includes a certain amount of energy, while the right channel R equals 0. In this case, it would have been of considerably more advantage not to perform an M/S processing, but solely an L/R processing. The effects on the number of bits required for coding a stereo signal thus extend in one extreme case from a saving of 50% to, in the other extreme case, a doubling of the bits required for coding. Thus, it has to be checked when the M/S method is applied, whether the item is suitable for an M/S processing or not. In the case in which a stereo signal (for example, a test sector of 20 ms, also called frame) is not suitable for an M/S processing, the M/S processing is dispensed with for reasons of a bit efficiency and both the left and the right channel are individually coded. This "normal" case is also called L/R processing.

Conventional audio coding methods, as are, for example, used to code audio signals which are decoded according to one of the MPEG standards, are generally divided into several steps. At first, an audio signal, for example, present in the form of PCM sample values, as are, for example, output by a CD player, is transformed into a spectral illustration by means of a time-frequency transform or a filter bank. Typically, a block with a certain number of sample values, also called "frame", is used to generate a block of complex spectral values forming a short-time spectrum of the frame of audio sample values ("samples"). The block formation is obtained using transform windows which are, for example, 1024 sample values long. If, for example, overlapping windows, the overlapping region of which is 50%, are used for transforming, 1024 spectral values are formed of 1024 sample values. These spectral values are then quantized by means of a well-known iteration process, whereupon the quantized spectral values are subjected to an entropy-coding, for example, using a plurality of fixed Huffmann code tables to finally obtain a bit stream which, on the one hand, contains the coded quantized spectral values and which, on the other hand, also comprises side information relating to the windows, to the scale factors calculated when quantizing and to further information required for decoding the bitstream.

A center/side processing can either be performed prior to the transform into the spectral range, that is using the digital time-discrete sample values. Alternatively, a center/side processing can also be performed after the transform, that is using the complex spectral values. The latter alternative, in addition, offers the advantage that a center/side processing cannot be used for the whole spectrum, as is the case in the time region, but also for certain frequency bands when certain spectral values are subjected to a center/side processing and others are not.

Usually, audio coders are designed in such a way that they provide a constant bit rate, that is a certain number of bits per second. Another marginal condition is that the quantizing noise introduced by quantizing is, if possible, selected in such a way that its energy is under the psychoacoustic masking threshold or listening threshold of the audio signal. The fundamental method of setting the quantizing noise in the frequency range consists in "shaping" the noise using the scale factors. For this purpose, the spectrum is divided into several groups of spectral coefficients, as is well-known, which are called scale factor bands, to which any individual scale factor is associated. A scale factor represents a multiplication value used to change the amplitude of all spectral coefficients in this scale factor band. This mechanism is used to set the allocation of the quantizing noise generated by the quantizer in the spectral range in such a way that the energy of the quantizing noise in each scale factor band is under the psychoacoustic masking threshold in this scale factor band. It can be seen that neither the quantizing nor the entropy coding are processes favouring a constant bit rate. On the contrary, it is to be noted that both processes favour a variable bit rate. For transmission applications however, it is often required that the coder comprises a constant bit rate at its output. In order to provide a constant bit rate, a so-called bit reservoir is usually used. If the audio signal is such that temporarily fewer bits than preset by the outer bit rate at the output of the coder are required, bits will be associated to the bit reservoir to be able to give more bits in the case of an audio signal sector requiring more bits for coding, by which the bit reservoir is emptied again.

It is to be noted that a marginal condition of such a coder is, as has been mentioned, the constant output bit rate and that the other marginal condition is that the quantizing noise be smaller than or equal to the psychoacoustic masking threshold, so that it is masked or covered by the audio signal.

In the following, possibilities are dealt with of what has to be done when the "inner bit rate" of the coder differs from the outer constant output bit rate. If the inner bit rate is that low that, for example, the bit reservoir is filled to its maximum value, there is, of course, no problem, since the quantizer can be controlled in such a way that it now quantizes even finer than required, by which more bits are required for quantizing. This is performed until the "outer" constant bit rate is reached.

More critical however, is the case in which the "inner bit rate" of the coder is higher than the constant bit rate required by the output. This case can arise when the audio signal is difficult to code, that is when the coder has to devote many bits to code the audio signal, which, in an illustrative way, can also be called a "high load" of the coder. For the transform coding, there is the maxim that tonal pieces can be coded relatively efficiently, that noisy signals, however, comprising relatively high amounts of energy and, in addition, comprising a relatively complicated spectrum, such as voice or percussion or drum music, can be compressed to a relatively low degree only. Even signals being transient, that is signals comprising an irregular time characteristic, can only be coded in a relatively complicated way when no coding artefacts are to be produced. In the case of transient signals, during windowing, it is switched from large windows to shorter windows to obtain a better time resolution or to obtain that the quantizing noise only "blurs" over a smaller number of audio sample values. In the case of short windows, there is considerably more side information.

A coder which determines that the output bit rate is not sufficient and which has also "emptied" the bit reservoir has several possibilities to reduce its inner bit rate "violently" to meet the criterion of the constant output bit rate. A possibility is to dispense with switching to short windows. This, however, results in audible coding artefacts.

A further possibility is to deliberately impede the psychoacoustic masking threshold when quantizing to quantize in a coarser way than required to obtain a lower bit rate. This also results in audible disturbances.

A further possibility is to lower the audio bandwidth, that is to no longer code the whole audio bandwidth, but to set spectral values above a certain threshold frequency depending on the output bit rate to 0 to reduce the output bit rate. This method does not result in audible quantizing disturbances but leads to a loss in higher frequencies in the audio signal. This loss, however, is often not perceived as strongly as an audible quantizing noise.

A special problem in decoding stereo signals is an effect called "Stereo Unmasking", which in the following will be explained briefly. If a normal L/R coding is used, both the left channel and the right channel are transformed, quantized and coded individually, so that the quantizing noise introduced into the left channel and the right channel for a data reduction is independent of the respective other channel. This means that the quantizing noise in the left channel and the quantizing noise in the right channel are not correlated. If the case is considered that the left and the right channel are relatively similar to each other, this means that, after decoding, a listener will perceive this signal in such a way that, for example, a speaker is in the center. The "Stereo Unmasking" effect is that, due to the fact that the quantizing noise in the two channels are not correlated, the quantizing noise of the left channel is perceived on the left-hand side and the quantizing noise of the right channel is perceived on the right-hand side. A high masking of the noise, however, only takes place in the center where the useful signal is, but not on the left-hand and the right-hand side.

M/S coding, apart from its data rate reducing effect, also has the advantage in special signals that the quantizing noise in both the left channel and the right channel is correlated with the quantizing noise of the respective other channel, so that the quantizing noise also takes place in the center and, at this place, is basically entirely or significantly better than in the uncorrelated case, respectively, masked by the useful signal. The case in which the left and the right channel are relatively dissimilar is different. If, in this case, an M/S coding is used, the useful signal, due to the stereo effects, will either be on the left-hand side or on the right-hand side, while the quantizing noise is correlated due to the M/S coding and rather in the center. In this case, a stereo unmasking also takes place as it were.

Lately, more and more scalable audio coders are examined. Scalable audio coders are arranged in such a way that their output side bit stream comprises at least a first and a second scaling layer. A decoder which is designed simply takes only the first scaling layer from the scaled bit stream, this layer, for example, comprising a coded audio signal with a reduced bandwidth or an audio signal coded by a simple coding algorithm. Another decoder which is designed fully takes both the first scaling layer and the second scaling layer from the bit stream to decode the first scaling layer by a first decoder and then to decode the second scaling layer as well, the latter, alone or together with the decoded first scaling layer providing an audio signal with a full bandwidth.

Scalable coders are especially desired in the field of stereo signals, since in this case, a mono signal, that is the center channel, can be used as the first scaling layer, while the side channel, for example, can be taken as the second scaling layer. A simple decoder or a decoder designed for a quick operation will only provide the mono signal, while a better decoder or a decoder in which the transmission speed is not the decisive criterion, will take the side layer apart from the mono or center layer to generate a full stereo signal at the output of the decoder.

There are various possibilities for the architecture of the scaling layers. The first scaling layer can differ from the second scaling layer or from any number of further scaling layers in the audio coding method itself, in the audio bandwidth, in the audio quality, relating to mono/stereo or a combination of the named quality criteria or other conceivable criteria. For a high coding efficiency, it is aimed at that the second scaling layer comprises a smallest possible number of bits or that a decoder decoding the second scaling layer also uses the first scaling layer as extensively as possible. When a scalable coder for stereo signals is considered, providing the center signal as a first scaling layer, that is the mono signal, and which, as a second layer, provides the side channel, it can be seen that its overall efficiency is the better, the more often the M/S coding is used. This requirement, however, with certain stereo signals, contradicts the bit efficiency, that is with stereo signals comprising a high stereo channel separation. On the other hand, the M/S processing provides a certain "natural" scalability and results in a correlation of the quantizing noise in the left channel and in the right channel.

The problems mentioned relating to the M/S coding are all the more true, the more an audio signal to be coded suddenly changes its features relating to the M/S coding. If an audio signal to be coded suddenly no longer has the feature that the left channel is similar to the right channel, the M/S coding gain no longer applies. An increase in the quantizing disturbance possibly exceeding the psychoacoustic hearing threshold and/or a reduction of the audio bandwidth depending on the specific implementation of the coder will be the consequences.

This problem becomes especially noticeable in scalable audio coding, but not only, and especially where the so-called mono-stereo-scalability is used, as has been detailed above.

SUMMARY OF THE INVENTION

It is the object of the present invention to provide a device and a method for processing a stereo audio signal, leading to less audible disturbances.

In accordance with a first aspect of the present invention, this object is achieved by a device for processing a stereo audio signal having a first channel and a second channel, comprising: an analyzer for analyzing said stereo audio signal or a signal derived from said stereo audio signal to obtain a measure for the quantity of bits required by a coder to code said stereo audio signal using a coding algorithm; and a modifier for modifying said first and said second channel to obtain a modified first and a modified second channel, said modifier responding to said analyzer to become effective if said measure for the quantity of bits exceeds a predetermined measure, and said modifier being designed in such a way that a characteristic, having a similar course as the energy of the sum signal, of a sum signal of said first and said second modified channel is in a predetermined relation to the characteristic of a sum signal of said first and said second channel and that a difference signal of said first and said second modified channel is attenuated in contrast to a difference signal of said first and said second channel.

In accordance with a second aspect of the present invention, this object is achieved by Method for processing a stereo audio signal having a first channel and a second channel, comprising: analyzing said stereo audio signal or a signal derived from said stereo audio signal to obtain a measure for the quantity of bits required by a coding algorithm to code said stereo audio signal; and modifying said first and said second channel to obtain a modified first and a modified second channel if, in the step of analyzing, a measure for the quantity of bits is determined, which exceeds a predetermined measure, said modifying being performed in such a way that a characteristic, having a similar course as the energy of the sum signal, of a sum signal of said first and said second modified channel is in a predetermined relation to a characteristic of a sum signal of said first and said second channel and that a difference signal of said first and said second modified channel is attenuated in contrast to a difference signal of said first and said second channel.

The present invention is based on the understanding that in stereo audio signals, it is often more favorable to dispense with a high stereo channel separation to obtain a higher audio bandwidth and/or a lower audible disturbance, compared with the case in which the stereo channel separation is maintained, while the audio bandwidth is reduced or disturbances introduced by quantizing become audible.

Experience has shown that a listener will perceive audible quantizing disturbances as being more unpleasant than a lower stereo channel separation. Audible quantizing disturbances generally are an alien element in an audio signal, while a listener of a stereo signal processed according to the invention does not necessarily know how the stereo channel separation of the original signal was and, thus, will not perceive a lower stereo channel separation as a coding artifact.

A decrease in the stereo channel separation is thus used to reduce the output-side bit rate of the coder generally or to a predetermined value.

An inventive device for processing a stereo signal comprising a first channel and a second channel includes a means for analyzing the stereo audio signal to obtain a measure for a quantity of bits required by a coder to code the stereo audio signal using a coding algorithm and a means for modifying the first and second channels to obtain a modified first channel and a modified second channel, the means for modifying being responsive to the means for analyzing to be operative if the measure for the quantity of bits exceeds a predetermined measure and the means for modifying being designed in such a way that a sum signal of the first and the second modified channel, at least according to a characteristic of the signal, which characteristic changes similarly to the energy of the signal, is basically equal to the characteristic of the sum signal of the first and the second channel and that a difference signal of the first and the second modified channel is attenuated, when compared to the difference signal of the first and second channels.

It is pointed out that the characteristic having a similar course as the energy can be the energy itself, but also, for example, the sum of squared sample values in a certain time period, the sum of squared spectral values in a certain frequency range, the sum of sample value magnitudes in a certain time period or the sum of squared spectral values in a certain frequency range or else a combination of two or more of the named characteristics. For reasons of simplicity, the energy is subsequently named as the characteristic having a similar course as the energy.

Modifying the stereo audio signal, that is reducing the channel separation, is performed under the precondition that the loudness of the signal does not fluctuate. A reduced channel separation itself will not result in disturbing artifacts in the decoded signal, a fluctuation of loudness, however, will do so. Thus, the first channel and the second channel, that is the left channel and the right channel, are modified in such a way that the loudness, that is the sum signal, when compared to the unmodified first and second channels, remains constant at least as far as energy is concerned and, preferably, also as far as the signal is concerned, while the difference signal is attenuated.

The inventive pre-processing of the stereo signal will set in whenever it is determined that the quantity of bits required to code the stereo audio signal becomes too high. The measure for the quantity of bits required for coding the stereo audio signal can be derived from the stereo audio signal by an analysis of same in different manners.

At first, the center and the side channel of the stereo audio signal can be considered to determine, due to an energy relation or a difference of the logarithms of the energies of same, as to how many bits are required. Without having to determine the precise number of bits, it can be deduced that in the case of a small energy relation between the center and the side channel, that is in the case of channels having approximately the same size, a high number of bits will be required. The lower the energy relation between the center and the side channel is, the higher an attenuation of the side channel will be required to obtain a certain output bit rate. A small energy relation between the center and the side channel is present when the original audio signal has a high stereo channel separation, for example, when the left channel has a high amount of energy, while the right channel essentially has noise. A small energy relation, however, is also present when the voice of a speaker is in the left channel and when the voice of another speaker is in the right channel, which leads to the fact that the left channel and the right channel may have equal amounts of energy, that both channels, however, are not correlated. In this case, too, there is a high stereo signal separation and the center channel and the side channel will have a relatively small difference of the logarithms of the energy.

A further possibility for determining the measure for a quantity of bits, however, independent of the nature of the center channel and the side channel therein, is to consider the coder itself. A measure for the number of bits required by a coder is the so-called perceptual entropy (PE), equaling the energy relation between the useful audio signal and the psychoacoustic mask threshold calculated for the useful audio signal. If the PE is large, it can be deduced that the audio signal has a relatively low masking capability. If the PE, however, is small, that is if the energy of the useful signal is only a little above the psychoacoustic mask threshold, the useful signal only has to be quantized in a relatively coarse way, the quantizing noise still being "hidden" under the psychoacoustic listening threshold. If it is determined that the sum of the PE of the left channel, preferably averaged over a certain time, and the PE for the right channel, preferably also averaged over a certain time, is above a predetermined value, the side channel is attenuated according to the invention to reduce the required number of bits. This alternative aspect of the present invention thus does not deal with the individual appearance of the center channel and the side channel but with the stereo audio signal itself, which is not judged by its M/S codability but by its general audio-codability, that is the difficulty to code same to obtain a certain target bit rate.

A generalization of the second aspect is to use any other quantity as a measure for the quantity of bits, pointing to the "load" of the coder. Such a quantity can, for example, also be a signal indicating due to the transient features of the audio signal that an audio coder has to use short windows for windowing, since it is a fact that short windows, also due to the increasing number of side information, require a higher bit rate. Thus, for the purpose of the present invention, the whole range of controlled variables of an audio coder can be used to find a measure of that or how strongly the side channel has to be attenuated to reduce the output bit rate of the coder.

Preferred embodiments of the present invention perform a time-increasing or time-decreasing attenuation of the side channel to prevent that a listener directly perceives the decreasing stereo channel separation, but that the decrease in stereo channel separation takes place step-by-step or that the increase in stereo channel separation increases step-by-step, to conceal the coder side manipulation of the stereo audio signal as far as possible.

It is to be pointed out that, for maintaining a non-fluctuating loudness due to modifying, the sum signal of the modified left channel and right channel, does not necessarily have to be identical to the sum signal of the non-modified left channel and right channel, but that it is sufficient that solely the energies of the two sum signals are essentially equal or are in a predetermined relation to each other. A listener does not know how great the loudness of the un-modified stereo audio signal has been and, thus, will not perceive it as a disturbance when a loudness change towards a higher loudness or lower loudness is introduced by the pre-processing. Due to the simplicity of the implementation, however, it is preferred that this relation equals 1.

Preferred embodiments of the present invention are subsequently detailed referring to the enclosed drawings in which.

Figure 1:
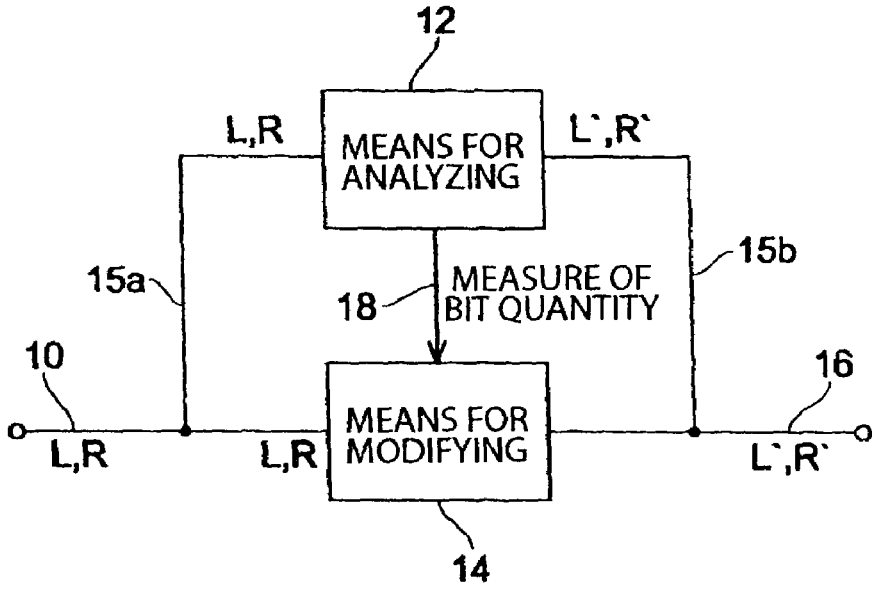
FIG. 1 shows a principle block diagram of the inventive device for processing a stereo audio signal.

FIG. 1 shows a block diagram of the inventive device for processing a stereo audio signal fed to the device at an input 10 and comprising a first channel L and a second channel R. The stereo audio signal in the form of the first channel L and the second channel R is, on the one hand, fed to a means 12 for analyzing the stereo audio signal and, on the other hand, is also fed to a means 14 for modifying the first and the second channel to obtain a modified first channel L' and a modified second channel R' at an output 16. Generally, the modified first channel L' and the modified second channel R' at the output 16 will differ from the non-modified first channel L and the non-modified second channel R' at the input 10 in that the modified stereo audio signal applying at the output 16 has a lower channel separation than the non-modified stereo audio signal at the input 10.

The means 12 for analyzing the stereo audio signal finds a measure for the quantity of bits required by a coder not shown in FIG. 1 to code the stereo audio signal using a coding algorithm preset by the coder. The measure for the bit quantity is fed from the means 12 for analyzing via a signal path 18 to the means 14 for modifying. If the measure for the bit quantity, fed via the signal path 18 exceeds a predetermined measure, the means 14 for modifying become effective to modify the first channel L and the second channel R. According to the invention, the modification of the first and second channels is performed in such a way that the energy of the sum of the modified stereo audio signal at the output 16 is in a predetermined relation and, preferably, approximately equal to the energy of the non-modified stereo audio signal at the input 10, while the difference signal, however, which apart from the factor of, for example, 0,5, corresponds to the side channel, is attenuated in the modified stereo audio signal at the output 16 unlike the non-modified stereo audio signal at the input 10.

In FIG. 1, two possibilities for feeding the means 12 for analyzing are illustrated, these possibilities being usable individually or in combination. The first possibility is illustrated by a left arrow 15*a* to a certain extent illustrating a forward coupling, that is the means for analyzing the stereo audio signal is fed by the non-modified signal L, R. The other possibility is to feed the means 12 for analyzing with the modified signal L', R'. In particular in those cases in which the attenuation of the side signal is temporally slowly, it is not important as to whether the attenuation is controlled depending on the current non-modified signal or on one of the last processing blocks of the modified signal to a certain extent in a feedback way. Thus, it is irrelevant as to whether the stereo audio signal itself is directly analyzed or indirectly with the help of a preceding modified signal.

Subsequently, various designs of the means 12 for analyzing the non-modified stereo audio signal at the input 10 will be explained. A possibility is that the means 12 for analyzing forms both the center channel and the side channel of the stereo audio signal and then considers the relation of the energies of the center channel and the side channel. The energy relation between the center channel and the side channel is preferably averaged over a certain time, for example, being in the order of magnitude of 10 audio frames, which corresponds to a value of 200 ms when an MPEG-2-AAC coder which can have a frame length of about 20 ms is used as an audio coder. Referring to the MPEG-2-AAC coder, reference is made to the standard ISO/IEC 13818-7, in which the individual functional blocks of an audio coder and an audio decoder as well as their interacting are described in detail.

If it is determined that the energy relation or the difference of the logarithms, respectively, is smaller than a certain value to be determined empirically depending on the case of application, the value, for example, being selected to be 6 dB, the means 14 for modifying is activated to obtain an attenuation of the side channel as will be explained in greater detail referring to FIG. 2. According to the first aspect of the present invention already described, the means 12 for analyzing the stereo audio signal thus functions on account of a direct examination of the MS codability of the stereo audio signal. In an implementation of this first aspect of the present invention, the inventive device for processing the stereo audio signal will only attenuate the side channel if the signal does no longer have as good an MS codability because, for example, both channels are dissimilar to each other concerning their energy and/or signal. According to this aspect, a stereo channel separation will thus always be reduced if maintaining the original stereo channel separation leads to too high an output bit rate and if the stereo channel separation has been high.

According to a further aspect of the present invention, the attenuation of the side channel is used for reducing the output-side coder bit rate, regardless whether the stereo audio signal has a certain MS codability or not. This second inventive aspect assumes that even in the case of a low stereo channel separation a further attenuation of the side channel can still be obtained not to exceed a predetermined output bit rate of the audio coder. For this, irrespective of the MS codability of the audio signal, the number of bits required to code the audio signal is estimated.

As is known in technology, modern audio coders and, for example, an MPEG-2-AAC audio coder as well, use a psychoacoustic model serving to calculate the frequency-dependent psychoacoustic masking threshold of an audio signal to be coded. Roughly speaking, the psychoacoustic model provides an energy value as a psychoacoustic masking threshold for each scale factor band. If the quantizing noise introduced by the quantizer is below the energy value or if the noise introduced by the quantizing disturbances equals the energy value, the introduced quantizing noise, corresponding to psychoacoustic theory, will be basically inaudible.

The energy relation or the difference of the logarithms of the audio signal itself and its psychoacoustic masking threshold, also called Perceptual Entropy (PE) thus provides a measure as to how many bits are required for coding the audio signal. If the PE is high, many bits are required, since the masking capability of the audio signal is relatively low and, thus, a fine quantization has to be performed. If the PE, however, is small, relatively few bits are required, since the audio signal is masked relatively well, thus only a relatively coarse quantizing being required.

According to a preferred embodiment, in the second aspect of the present invention, the measure for the quantity of bits is determined as follows. The PE values for the individual scale factor bands are integrated above the frequency, that is, summed. This is performed for both the left channel and the right channel. The PE sum for the left channel is then added to the PE sum for the right channel. This sum PE value of the left and right channels is the bit requirement for a frame. This sum channel PE value is then preferably averaged over a certain number of frames, for example, 10, to obtain an average PE value for the stereo audio signal. If this average PE value is equal to or greater than a predetermined value typically to be determined empirically, the means for multiplying is activated to attenuate the side channel.

Generally, any other controlled variable can be used as a measure for the quantity of bits required by a coder, this variable representing a measure of the "load" of the coder, such as a control signal of the coder signaling the use of short windows when windowing. Windowing with short windows per se results in a higher number of bits, since shorter windows cannot be coded saving as many bits as is the case with longer windows.

Referring to the attenuation amount of the side channel, there are several possibilities differing as far as their expenses are concerned. The simplest manner is to specify a predetermined attenuation value as a target value which can, for example, be empirically fixed A further possibility, however, is to determine the attenuation value adaptively, that is to attenuate the side channel by a predetermined increment amount and then to see whether the number of bits has already decreased sufficiently or not. A new iteration loop with another increment attenuation amount can then be entered to determine in turn whether the number of bits is already sufficiently low. This method can be repeated until the number of bits required by the coder is in a target region. It can, however, be seen that the calculating time and implementing expenditure in the case of the adaptive attenuation adjustment is considerably higher than in the case of a predetermined attenuation. On the other hand, an adaptive attenuation adjustment provides the best and most accurate results.

In the following, reference is made to FIG. 2 in which a detailed illustration of the means 14 for modifying is illustrated according to a preferred embodiment of the present invention. The means 14 for modifying can be interpreted in such a way that it comprises a first input 20*a* for the first channel L and a second input 20*b* for the second channel R.

The means 14 includes a first multiplier 22*a* for multiplying the first channel L by a certain factor x, a second multiplier 22*b* for multiplying the first channel L by a factor y, a third multiplier for multiplying the second channel R by the factor x and, finally, a fourth multiplier 22*d* for multiplying the second channel R by the factor y. Furthermore, the means 14 for modifying includes a first summer 24*a* for summing the output signal of the first multiplier 22*a* and the output signal of the fourth multiplier 22*d* and a second summer 24*b* for summing the output signal of the second multiplier 22*b* and the output signal of the third multiplier 22*c*. The modified first channel L' is applied at the output 26*a* of the first summer 24*a* and the modified second channel R' is applied at the output 26*b* of the second summer 24*b*.

In the following, the determination of the two multiplication factors x, y will be explained to obtain an attenuated side channel, while the center channel at the output 26*a*, 26*b* equals the center channel at the input 20*a*, 20*b* of the means 14 shown in FIG. 2. For a signal processing performed by the means 14 for modifying the following matrix applies:

$$L'=xL+yR \tag{1}$$

$$R'=yL+xR \tag{2}$$

It is the object to determine x and y so that the following applies:

$$L'+R'=L+R=2M=2M', \tag{3}$$

and, in addition, the following applies:

$$L'-R''=S''=\text{attenuation}*S=\text{attenuation}*(L-R) \tag{4}$$

The result is:

$$M=0,5(x+y)(L+R) \tag{5}$$

Since M is not to be modified by the processing, the following equation also applies:

$$x+y= \tag{6}$$

For the side channel, the following is true:

$$S=0,5(x-y)(L-R) \tag{7}$$

The result of equation (7) is that S is reduced by the factor x-y or, expressed logarithmically, attenuated by 10·log 10(x−y)dB=att. att stands for the attenuation, att being smaller than 0 dB.

For an attenuation in dB steps, the following applies:

$$att(\text{in dB})=20*\log 10(x-y) \tag{8}$$

The following expression results from equation (8):

$$exp(0,5att)=x-y \tag{9}$$

The result of equations (6) and (9) is x for equation (10) and y for equation (11).

$$x=0,5*(1+\exp(0,5att)) \tag{10}$$

$$y=0,5*(1-\exp(0,5att)) \tag{11}$$

The attenuation "att" (in dB) is determined depending on one of the described controlled variables. Thus, with the equations (9) and (10), the factors x and y result for the attenuation matrix illustrated in FIG. 2, reflecting, in the form of equations, in the equations (1) and (2). To save implementing and calculating expenditure, an entire adaptive adjustment of the attenuation att does not have to be performed, whereas a determined attenuation value att empirically established can be used if the measure for the quantity of bits exceeds a predetermined threshold value.

According to the invention, the attenuation is not increased suddenly, since a decrease in the channel separation taking place suddenly may lead to an audible disturbance or to an astonishment on the side of the listener, for example, if a speaker is at first placed on the left-hand side and is suddenly perceived in the center. Thus, in the case in which it is determined that the side channel is to be attenuated, a gradual attenuation of the side channel, for example, using a predetermined increment value is carried out in such a way that, expressed clearly, the news speaker slowly "moves" from the left side to the center. If it is determined in the opposite case that the measure for the quantity of bits is again smaller than the predetermined value, the attenuation is not stopped suddenly, but slowly brought back to zero in such a way that, to stay with the example, the speaker slowly "moves" from the center to the side again. This gradual attenuation or stepwise elimination of the attenuation is to take place as slowly as possible so that the attenuation of the side channel is practically not perceived. The reduction of the attenuation, however, has to take place quickly enough so that the coder, due to the high bit rate at the output, does not start to impede the psychoacoustic masking threshold or to remove the audio bandwidth, respectively. According to the invention, in coders comprising a bit reservoir mechanism, this bit reservoir is thus fully made use of to increase the attenuation slowly until the target value is reached, in which the attenuation is so high that the predetermined bit rate at the output of the coder can be kept up. If the attenuation is then stopped again, the bit reservoir can be emptied again.

Figure 2:
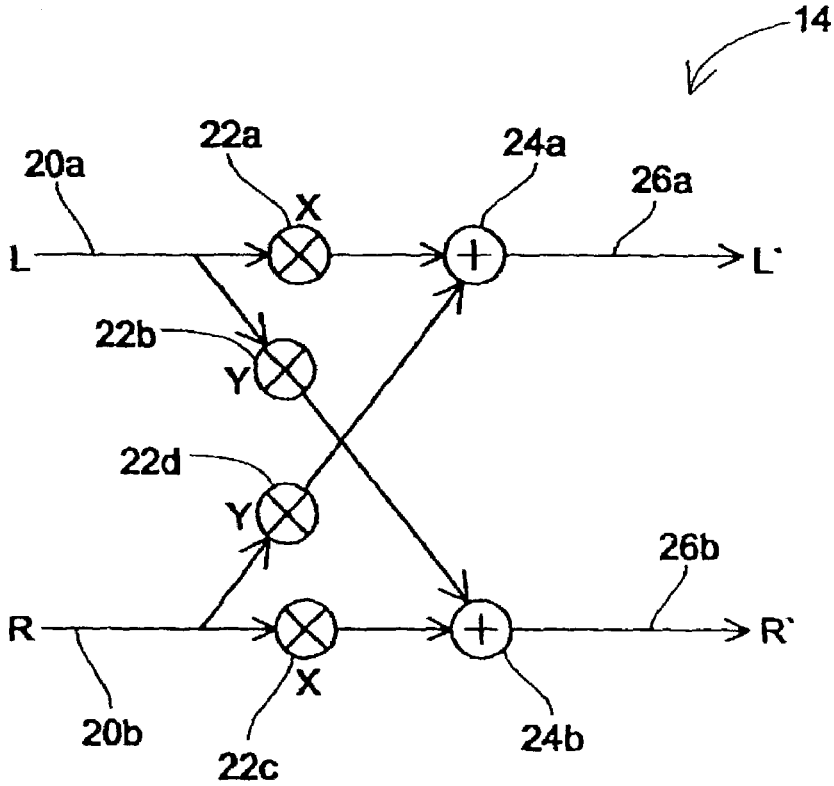
FIG. 2 shows a detailed illustration of a preferred design of the device for modifying.

In the implementation illustrated in FIG. 2, a marginal condition for determining x and y was such that the sum signal corresponding to the center channel, except for the factor 0,5, was not changed. However, signals are conceivable in which the left channel and the right channel are similar but have a phase shift in the range of 180° to each other. It is pointed out that such signals are not to be found frequently, since they cannot be represented by mono-replay units very well. Nevertheless, such signals are conceivable. In this case, the center channel M would become small and the side channel would become large. If S were attenuated so strongly that S became smaller than M, the overall loudness would also strongly be influenced. Contrary to a reduction of the stereo channel separation, however, it is not tolerable for a listener when the loudness fluctuates strongly, irrespective of the audio signal itself. A listener will perceive such a disturbance as annoying.

In order to avoid this problem, it is preferred to establish additionally in the means 12 for analyzing whether the phase shift of L and R is in the proximity of 180°. If this is established, the sign of R can just be reversed. The three-dimensional stereo effect originally wanted, however, is then lost, but the effect of the reduced loudness is prevented, which will not disturb a listener too much.

As an alternatively to the sign reversal, the M channel could also be amplified to a predetermined value in the means for modifying or in a downstream coder stage in such a way that the energy of the modified M channel is in a predetermined relation to the energy of the M channel of the un-modified stereo audio signal. For the energy relation, a value of 1 is preferred, wherein a certain amplification or attenuation can also be performed by the modification means, wherein the relation to the non-modified stereo audio signal, however should always essentially be maintained, so that a listener will not perceive essential loudness fluctuations due to the pre-processing. As a matter of fact, small loudness fluctuations are not as problematic and sometimes cannot even be perceived. Great loudness fluctuations, however, are annoying for a test listener.

It is to be pointed out at this stage that it is not important whether time-discrete sample values or spectral values are applied at an input 10 of the inventive device for processing a stereo audio signal. All the operations for analyzing the stereo audio signal can be performed with both time-discrete sample values and spectral values. In addition, all the operations in a means for modifying can be performed with both time-discrete sample values and spectral values. The inventive device for processing a stereo audio signal thus could also be arranged after the time-frequency transform stage of a time/frequency transform-based coder, such as, for example, an MPEG audio coder. This concept even yields the additional possibility that the stereo pre-processing can be performed in a frequency-selective way, that is that, for example, a different attenuation of the signal S can be performed depending on the frequency. This is especially practical, since the possibility of the direction finding of the human hearing is not equally sensitive for all frequencies. If, thus, the inventive processing is performed on a spectral value basis, spectral values of the side channel can be attenuated the stronger the less the human hearing hears in a direction-depending way in this frequency range, while spectral values which are in frequency ranges in which the human hearing provides a good direction finding are not changed at all or only slightly.

It is pointed out that in modern audio coders it is established using the so-called M/S mask as far as the frequency is concerned anyway, where an M/S coding is to be performed and where an L/R coding is better. In this case, the inventive processing would only be applied to those frequency ranges in which an MS coding is present, that is in which the MS mask is set. Alternatively, the MS mask could also be set in more bands, that is an MS coding could be performed, wherein in these, compared to the well-known method, additional MS bands the side channel is attenuated to meet the bit rate requirements.

In the following, reference is made to FIG. 3 in which a device for processing a stereo audio signal is illustrated, the device, in addition to the functional blocks shown in FIG. 1, also including an MS coder 30 and a scalable coder 32 outputting a scalable bit stream BS on the output side. As is well-known in technology, the MS coder 30 includes a summer 30*a* for summing the modified left channel L' and the modified right channel R' to generate the multiplied center channel after a multiplication by a multiplier 30*b* to which a factor of, for example, 0,5 is associated. In addition, the MS coder 30 includes a subtracter 30*c* and a further multiplier 30*d* to generate the modified side channel S' which, in contrast to a side signal formed of the non-modified stereo audio signal at the input 10, is attenuated. The center channel M' and the side channel S' are both fed to the scalable coder 32 preferably comprising a mono-stereo scalability. The first scaling layer represents the mono signal M', the second scaling layer including the modified side channel S'. There are further scaling possibilities, such as that the modified or non-modified mono channel M' is additionally band-limited and that, in the second scaling layer, the upper mono band is also contained apart from the modified side channel.

The effect of the scalability in the mono-stereo coder 32 is especially favorable when no LR coding, but an MS coding is used. The inventive stereo signal processing by the means 12 and 14 thus is especially advantageous in combination with the scalable coder 32. To obtain a mono-stereo-scalability, an MS coding can also be used, even if it is no longer preferred compared with the LR coding. This is obtained by the fact that the side channel at the input of the scalable coder 32 is attenuated in contrast to the un-modified case.

Figure 3:
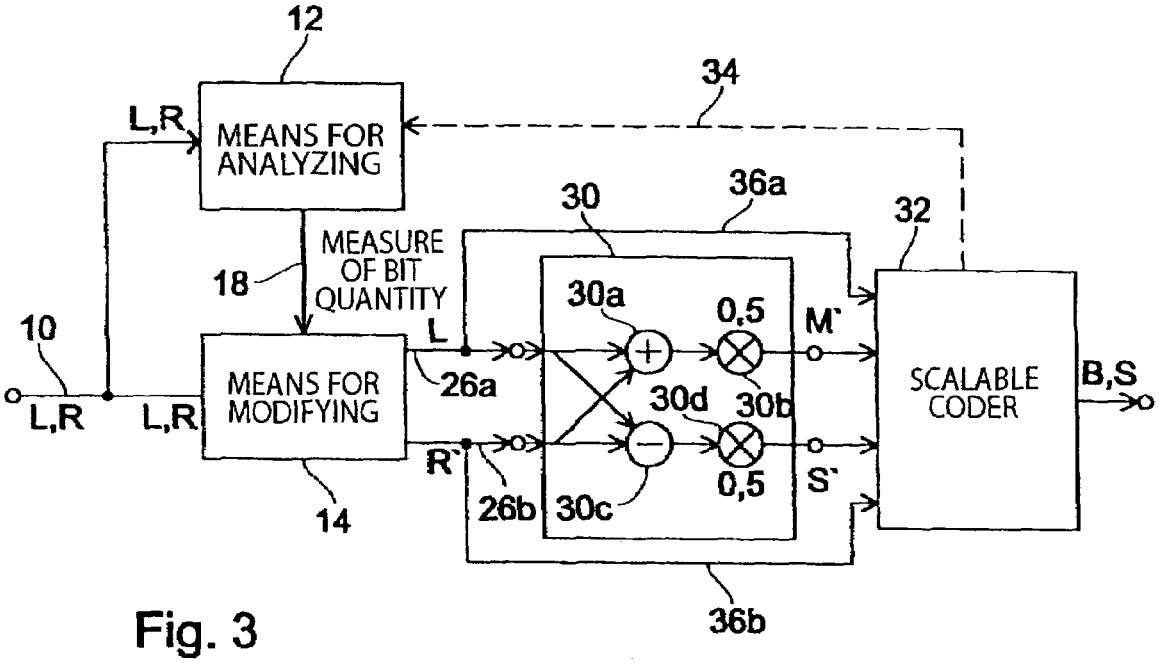
FIG. 3 shows a block diagram of an inventive device as a pre-processing stage for a scalable coder with mono/stereo scalability.

In FIG. 3, a dotted signal path 36 from the scalable coder 32 to the means 12 for analyzing is also shown. This dotted signal path 36 is to symbolize that certain actions to derive a measure for the quantity of bits required by the scalable coder to code the stereo audio signal at the input 10 do not have to be calculated directly at the means 12, but can be output from the scalable coder into the means 12, such as the perceptual entropy PE, the reference to the usage of short windows, etc. This means that these functional blocks do not have to be present in both the means 12 for analyzing and the scalable coder 32, but that the implementation of same in the scalable coder 32 alone is enough.

In this case, the means for modifying 14 would not perform a modification to determine the measure 18 for the bit quantity. In a certain sense the means shown in FIG. 3 thus would be in a "pre-mode" in which no bit stream is written, but in which solely the required attenuation degree for the side channel is determined. In the following coding mode in which the bit stream BS is then written by the scalable coder, the means 14 for modifying will function with correspondingly established factors x, y.

If the means shown in FIG. 3 is operated by spectral values for the first channel L and the second channel R and if the scalable coder is a time/frequency transform coder, the stage of the scalable coder 32 performing the time-frequency transform will be upstream of the input 10. The means 12, 14 and 30 would then be embedded into the scalable coder 32.

The signal paths 36*a*, 36*b* illustrate that the modified channels, too, can be led to the scalable coder without an M/S coding, so that it can establish whether an M/S coding or an L/R coding is more favorable.

The invention claimed is:

1. Device for processing a stereo audio signal having a first channel and a second channel to obtain a modified stereo signal having a modified first channel and a modified second channel to be inpute into an encoder using an encoding algorithm comprising:

an analyzer for analyzing said stereo audio signal or a signal derived from said stereo audio signal to obtain a measure for the quantity of bits required by a coder to code said stereo audio signal using a coding algorithm; and a modifier for modifying said first and said second channel to obtain a modified first and a modified second channel, said modifier responding to said analyzer to become effective when said measure for the quantity of bits exceeds a predetermined measure, and said modifier being designed in such a way that a characteristic of a sum signal of said first and said second modified channel, the characteristic having a similar course as the energy of the sum signal, is in a predetermined relation to the characteristic of a sum signal of said first and said second channel and that a difference signal of said first and said second modified channel is attenuated in contrast to a difference signal of said first and said second channel.

2. Device according to claim 1, in which said analyzer comprises:

a sum characteristic determinator for determining the characteristic of the sum of said first and said second channel over a predetermined time period;

a difference characteristic determinator for determining the characteristic of the difference of said first and said second channel over a predetermined time period; and a relation former forming the relation of the characteristic of the sum of said first and said second channel and the characteristic of the difference of said first and said second channel, the relation of the characteristics being the measure for the quantity of bits.

3. Device according to claim 1, in which said analyzer comprises:

a first determinator for determining a first characteristics relation between said first channel and a psychoacoustic masking threshold of said first channel over a predetermined time;

a second determinator for determining a second characteristics relation between said second channel and said psychoacoustic masking threshold of said second channel over a predetermined time; and a summer for summing said first and said second characteristics relation, the sum of said first and said second characteristics relation hinting to said measure for the quantity of bits.

4. Device according to claim 1, in which said encoder is arranged to use, responsive to the temporal structure of said stereo audio signal, long or short windows for transforming said temporal stereo audio signal into a spectral stereo audio signal, and in which said analyzer is arranged to detect whether short or long windows are used in said encoder, said measure for the quantity of bits being that short windows are used.

5. Device according to claim 1, in which said modifier is arranged to become effective such that the difference signal of said first and said second channel is step by step attenuated departing from no attenuation to a certain attenuation and to be effective such that the attenuation is step by step reduced from the determined attenuation to no attenuation.

6. Device according to claim 5, in which the speed of the attenuation is selected to be as slow as possible, but not that fast so that said encoder having a bit reservoir mechanism does not reduce the audio bandwidth or does not violate a psychoacoustic masking threshold when quantizing.

7. Device according to claim 1, in which said modifier is arranged to adaptively attenuate the difference signal depending on the determined measure.

8. Device according to claim 2, in which said modifier is arranged to attenuate the difference signal depending on a characteristics relation generated by said relation former so that the attenuation of the difference signal is high when the characteristics relation is small and that the attenuation of the difference signal is low when the characteristics relation is high.

9. Device according to claim 7, in which said modifier is designed in such a way that it adaptively attenuates the difference signal in such a way that the characteristics relation of the difference signal to the sum signal is essentially equal to a predetermined value.

10. Device according to claim 1, in which said modifier comprises:

a first multiplier for multiplying said first channel by a first factor;

a second multiplier for multiplying said first channel by a second factor;

a third multiplier for multiplying said second channel by said first factor;

a fourth multiplier for multiplying said second channel by said second factor;

a first summer for summing the output signal of said first multiplier and the output signal of said fourth multiplier to generate the modified first channel; and a second summer for summing the output signal of said third multiplier and the output signal of said second multiplier to generate the modified second channel, said first and said second factor being selected in such a way that the sum signal of said first and said second channel and the sum signal of said modified first and second channels are essentially equal and that the difference signal is attenuated by a certain factor.

11. Device according to claim 1, in which said analyzer further comprises:

a phase angle determinator for determining whether a phase angle between said first and said second channel has a value in the vicinity of 180°; and said modifier further comprising:

a reversor for reversing the sign of a channel when the phase angle is in the vicinity of 180°.

12. Device according to claim 1, in which said first and said second channel of said stereo signal are given by spectral values having been generated from a temporal stereo signal by a transfer into the spectral range, said modifier being arranged to perform a frequency-selective attenuation of said difference signal.

13. Device according to claim 12, in which modifier is arranged to more strongly attenuate in a frequency range in which the direction order of the human hearing is reduced than in a frequency range in which the direction finding of the human hearing is not reduced.

14. Device according to claim 1, further comprising:

a center generator for generating a center channel equaling half the sum of said modified left and said modified right channel;

a side generator for generating a side channel equaling half the difference of said modified first channel and said modified second channel; and wherein the encoder is a scalable encoder arranged to code said center channel and to write into a bit stream as a first scaling layer, and further being arranged to encode said side channel and to write into said bit stream as a second scaling layer.

15. Device according to claim 14, in which said scalable encoder is arranged to use a bit reservoir for the case in which the measure for the quantity of the bits-exceeds a predetermined value, in order not to reduce the audio bandwidth and/or not to violate the psychoacoustic masking threshold.

16. Device according to claim 1, in which the characteristic having a similar course as the energy is the energy itself, the sum of squared sample values in a certain time period, the sum of squared spectral values in a certain frequency range, the sum of sample value amounts in a certain time period and/or the sum of squared spectral values in a certain frequency range.

17. Device according to claim 1, in which said stereo audio signal is processed block-wise, and in which said signal used in analyzing and derived from said stereo audio signal is the modified signal of a preceding processing block.

18. Method for processing a stereo audio signal having a first channel and a second channel to obtain a modified stereo signal having a modified first channel and a modified second channel to be encoded using an encoding algorithm, comprising:

analyzing said stereo audio signal or a signal derived from said stereo audio signal to obtain a measure for the quantity of bits required by the encoding algorithm to encode said stereo audio signal; and modifying said first and said second channel to obtain a modified first and a modified second channel when, in the step of analyzing, a measure for the quantity of bits is determined, which exceeds a predetermined measure, said modifying being performed in such a way that a characteristic of a sum signal of said first and said second modified channel, the characteristic having a similar course as the energy of the sum signal, is in a predetermined relation to a characteristic of a sum signal of said first and said second channel and that a difference signal of said first and said second modified channel is attenuated in contrast to a difference signal of said first and said second channel.

* * * * *